United States Patent [19]

Zarotti

[11] Patent Number: 4,944,044

[45] Date of Patent: Jul. 31, 1990

[54] PADDING ELEMENT FOR PROTECTION AGAINST SHOCKS, PARTICULARLY FOR A CRASH HELMET

[75] Inventor: Claudio Zarotti, Milan, Italy

[73] Assignee: VELA S.r.l., Milan, Italy

[21] Appl. No.: 323,592

[22] Filed: Mar. 14, 1989

[30] Foreign Application Priority Data

Mar. 14, 1988 [IT] Italy ..... 19757 A/88

[51] Int. Cl.[5] ..... A42B 3/02

[52] U.S. Cl. ..... 2/413

[58] Field of Search ..... 2/413, 417; 165/46

[56] References Cited

U.S. PATENT DOCUMENTS

| | | | |
|---|---|---|---|
| 3,256,703 | 6/1966 | Selwitz | 165/46 |
| 4,035,846 | 7/1977 | Jencks | 2/413 |
| 4,340,626 | 7/1982 | Rudy | 2/413 |
| 4,663,785 | 5/1987 | Comparetto | 2/413 |

FOREIGN PATENT DOCUMENTS

| | | | |
|---|---|---|---|
| 2387611 | 12/1978 | France | 2/413 |

*Primary Examiner*—Werner H. Schroeder
*Assistant Examiner*—D. Price
*Attorney, Agent, or Firm*—Sughrue, Mion, Zinn, Macpeak & Seas

[57] ABSTRACT

A padding element for protection against shocks, particularly useful with a crash helmet, which confers on the helmet unusual adaptability to the user's head, comprises at least one deformable vesicle containing a fluid which, in use of the padding element, is a saturated vapor state, a Peltier-effect thermoelectronic component having a face in contact with a surface section of said at least one vesicle, and a power supply for supplying an electric current in either directions to said component, so as to either develop or absorb heat from said face and adjust the vesicle internal pressure.

18 Claims, 2 Drawing Sheets

PADDING ELEMENT FOR PROTECTION AGAINST SHOCKS, PARTICULARLY FOR A CRASH HELMET

BACKGROUND OF THE INVENTION

This invention relates to a padding element for protection against shocks, particularly useful with a crash helmet, being of a type which comprises at least one deformable vesicle containing a fluid which, in use of the padding element, is in a saturated vapor state.

Such an element is described in Italian Patent Application No. 24165-A/84.

While being in many ways satisfactory, known padding elements still exhibit some shortcomings to be overcome.

In fact, a crash helmet equipped with such padding elements may, especially in motorcycling applications, be relatively uncomfortable to wear when used under extreme running and climatic conditions.

The rider may indeed find him/herself in environmental situations varying between several degrees centigrade below zero and over forty degrees above. In addition, speed is a determining factor in that it causes the convective heat transfer coefficient to change, and air finds its way past the helmet sealing arrangement.

Thus, either a condition of flabby helmet padding may be experienced, whereby the helmet is liable to shake and sway on the user's head, or of an excessively swelled padding, whereby the helmet is bound to exert an objectionable pressure.

The problem that underlies this invention is to provide a padding element of the type specified above, which has such structural and performance characteristics as to obviate the cited shortcomings of the prior art.

SUMMARY OF THE INVENTION

This problem is solved by a padding element as indicated being characterized in that it comprises a temperature adjuster means associated with said at least one vesicle to vary the vesicle internal pressure.

BRIEF DESCRIPTION OF THE DRAWINGS

Further features and the advantages of a padding element according to this invention will be apparent from the following detailed description of a preferred embodiment thereof, given by way of illustration and not of limitation with reference to the accompanying drawings, where.

DETAILED DESCRIPTION OF THE INVENTION

Figure 1:
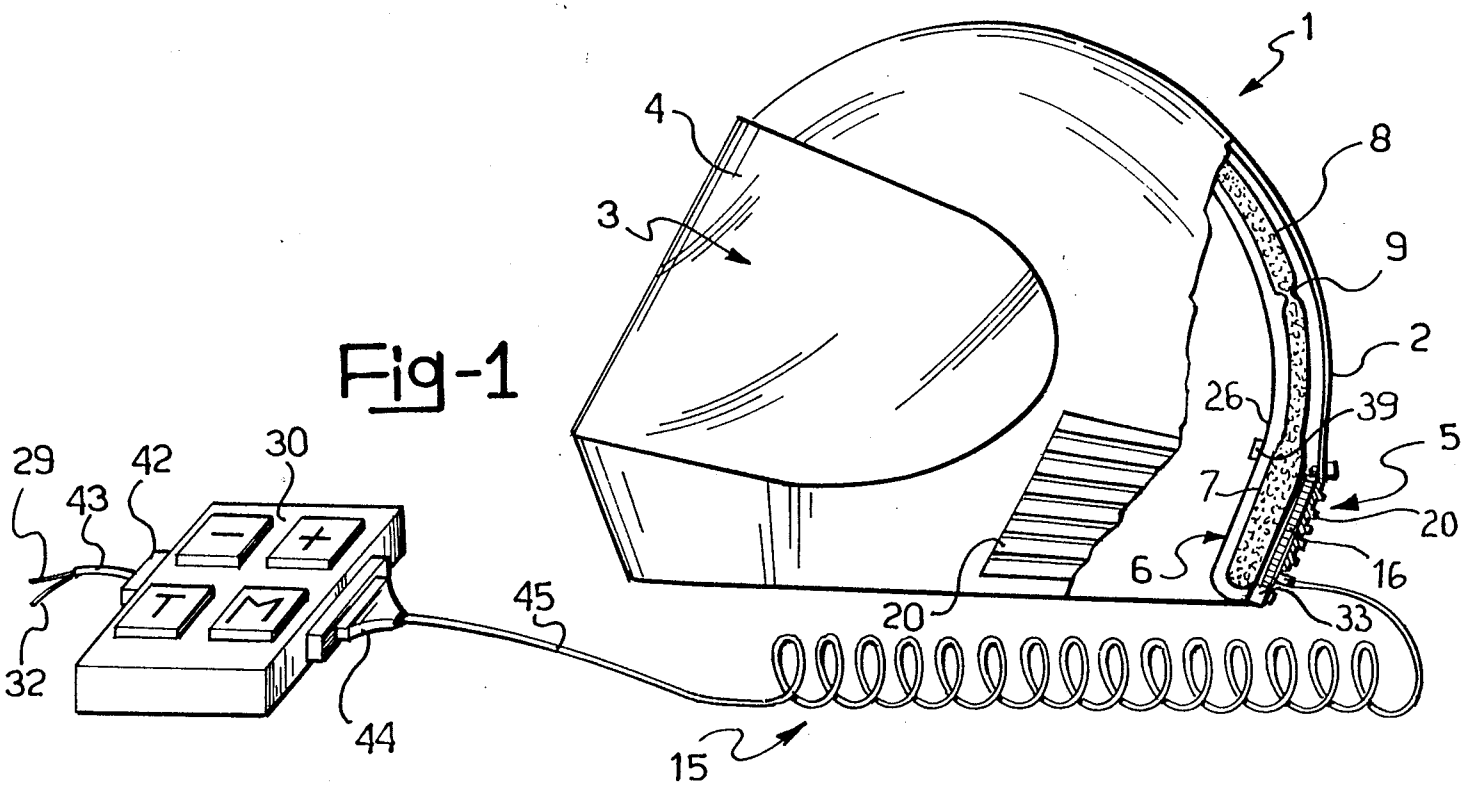
FIG. 1 is a part-sectional elevation view of a crash helmet incorporating a padding element according to the invention.
Figure 2:
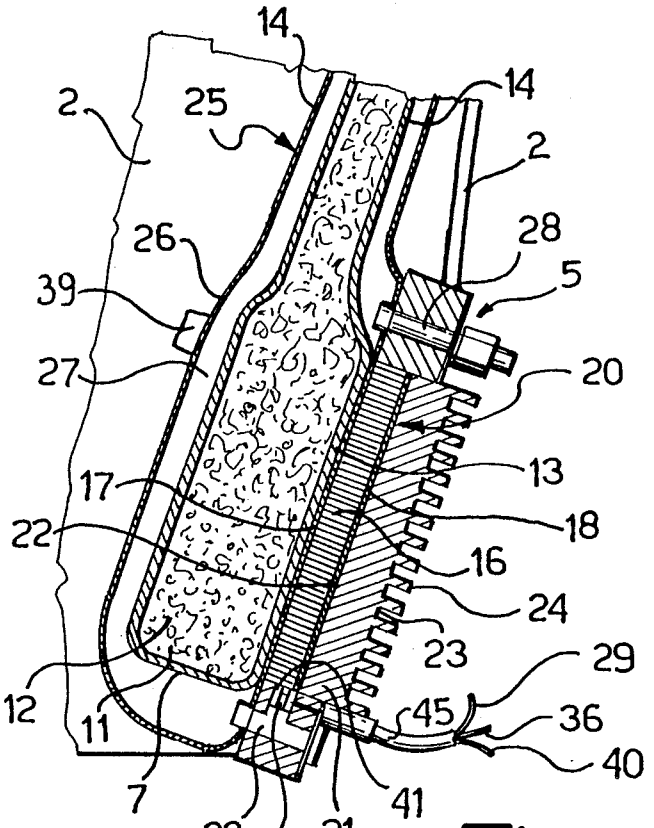
FIG. 2 is an enlarged scale sectional view of a detail of the crash helmet shown in FIG. 1.
Figure 3:
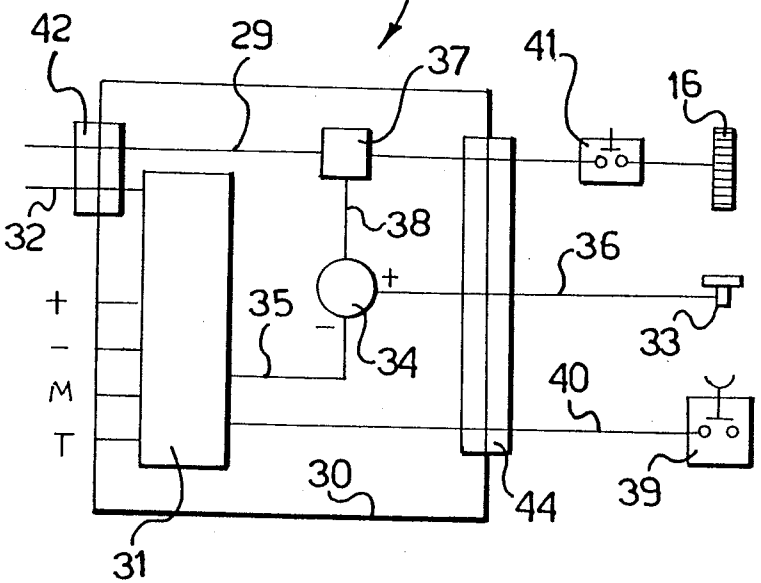
FIG. 3 is a view showing in schematic form another detail of the crash helmet of FIG. 1.

With reference to the drawing views, generally indicated at 1 is a crash helmet, of the so-called allround or enveloping type, having a crown 2.

The crown 2 is formed forwardly with an aperture 3, which is shielded by a visor 4. Rearwardly, the crown 2 is formed with a cutout 5 having a selected surface area for reasons to be explained.

The crash helmet 1 includes a padding element 6 according to the invention.

The padding element 6 comprises a deformable vesicle 7 which spans the interior of the crown 2 and is, for example, dendriform with branching-out limbs 8. Necked-in portions 9 are formed along the limbs 8.

The vesicle 7 contains a fluid 11 which, under normal conditions of use of the padding element, is in a saturated vapor state, i.e. in the presence of its liquid phase.

The fluid 11 has a boiling temperature in the 10° C. to 70° C. range.

Advantageously, the fluid is a non-azeotropic mixture, e.g. a mixture of Freon MF* and Freon TF*.

* registered trademark.

Freon MF is also called algofrene 11, with raw formula $C\,Cl_3F$, and Freon TF is also commonly referred to as algofrene 113, or delifrene HP, with raw formula $C_2Cl_3F_3$. Individually taken, they have boiling temperatures of about 23° C. and 47° C., respectively, at atmospheric pressure.

The amount percent of Freon MF in the mixture is selected within the range of 20% to 50% by volume of liquid. Best results have been obtained with a Freon MF proportion of 40%.

The vesicle 7 encloses a sponge matrix 12, made of a heat-conductive material, e.g. a polypyrrole sponge, which is soaked with the liquid phase and has saturated vapor dispersed therethrough.

The vesicle 7 is preferably formed from a laminate in which a layer comprises a very thin foil of metal (aluminum or an alloy thereof).

The vesicle 7 has a section 13 which extends at the cutout 5 in the crown, and a remaining section 14 which extends across the interior of the crown 2 and is facing the crown, on the one side, and the crown interior on the other.

The padding element 6 of this invention comprises a temperature adjuster means 15 associated with the vesicle 7 to vary the vesicle internal pressure.

Said temperature adjuster means 15 comprises a Peltier-effect thermoelectronic component 16 having two opposite faces 17 and 18, as well as a power supply 19 for supplying an electric current alternately in either directions to said component 16, thereby heat is respectively developed and taken up at said faces 17 and 18, and vice versa on reversing the current flow direction.

Of the two faces 17 and 18 of the component 16, one face, 17, is in contact with the section 13 of the vesicle 7, and the other, oppositely located and free, face 18 of the component 16 confronts the cutout 5 formed in the helmet crown.

The Peltier-effect thermoelectronic component is known per se, and available from a number of manufacturers, among which Cambridge Thermionic Corp., Borg-Warner Materials, Electronic Products Corp., and Marlow Industries, for example.

Indicated at 20 is a heat exchanger which is operative between the free face 18 of the component 16 and the environment. Said heat exchanger 20 is a metal plate 21 having a wall 22 in intimate contact with the free face 18 of the component 16 and an opposite wall 23 provided with fins 24 which extend through the crown cutout 5 and protrude on the helmet exterior to be swept by the surrounding air flow.

The padding element 6 according to the invention further comprises a heat-insulative liner 25 which extends at the section 14 of the vesicle 7. The liner 25 provides a deformable envelope enclosing the vesicle 7 and encircles the section 14 of the latter, to define an interspace 27 therebetween. The interspace 27 is filled with air, lead in through a duct 28 which is accessible from the crown outside and includes a conventional check valve, not shown.

The envelope 26 is formed preferably from a plastics material such as polythene.

The power supply 19 includes a line 29 connected through to a battery, not shown, and arranged to supply the component 16 with an electric current, via an electric control box 30 adapted for mounting, for example, on the instrument panel of a motorbike.

It should be noted that the battery would usually be the motorbike own battery; however, connection to a solar battery, to be mounted on the outer surface of the crash helmet itself, may be optionally provided.

The control box 30 contains a storage unit 31 connected to the battery over a line 32. The storage unit 31 is fed a pressure reference value through a key M. By operation of "plus" and "minus" keys, progressive increments and decrements of the pressure reference value can be writtent in.

Through a key T, a minimum pressure value is written in, which is practically the pressure at which the fluid is nearly fully condensed into the liquid phase.

The crash helmet 1 accommodates a pressure transducer 33 operative to sense the relative pressure of the fluid in the vesicle 7. The transducer 33 is facing the interspace 27, and accordingly, will measure the air pressure within the interspace directly, and the pressure of the fluid 11 within the vesicle 7 indirectly. Thus, the vesicle 7 is unaffected by a direct attachment of the transducer, and its integrity better safeguarded.

A comparator node 34 is in the box 30 which is supplied, over a line 35 from the storage unit, the value of the reference pressure, and over a line 36 from the pressure transducer, the measured pressure value, to issue a difference signal.

Housed within the control box 30, on the line 29, is an electric current control means 37 which is driven, over a line 38 from the comparator node, by said difference signal.

A microcontact 39 is mounted in the helmet 1 to activate the storage unit 31 over a line 40.

A thermal switch 41, such as a bimetal plate switch, is mounted in the helmet, at a location close to the component 16, and operates on the line 29 to cut it off on a predetermined temperature being reached.

The box 30 includes a terminal board 42 for hooking up the lines 29 and 32, as sheathed in a sleeve 43, and a quick-connect connector 44, such as a plug-and-socket assembly, for hooking up the lines 29, 36, and 40, sheathed in a sleeve 45.

The operation of the padding element of this invention will be described with reference to an initial condition whereby the crash helmet is on the point of being put on by the user, and the storage unit 31 has a generic pressure value stored therein. The helmet is at ambient temperature, and the fluid in the vesicle 7 is in the liquid state.

On putting on the crash helmet, the microcontact 39 is activated by the user's head to enable the current supply to the Peltier component 16. The current, under control by the control means 37 as driven by the difference between the pressure stored in the storage unit and the actual pressure in the vesicle as measured by the transducer 33*e*, achieves a steady state at the end of a transition period of a few seconds, at a value whereby the difference is cancelled, i.e. the measured pressure is equal to the stored pressure.

Where the user wants a higher or lower pressure, he/she can operate the "plus" and "minus" keys to vary the value of the stored pressure. As a result, the actual pressure in the vesicle is adjusted until the user finds the pressure level that best suit him/her.

In use of the crash helmet, e.g. during a motorbike ride, outdoor weather factors, such as heavy rain or summer sunshine, may induce a drop or rise in the vesicle internal pressure. Such a change would be promptly sensed by the transducer and converted, by the comparator node, into a positive or negative difference which acts on the control means to vary the current to the Peltier component in the opposite direction, until the actual pressure is brought back to the desired reference value.

In particular, the electric current flowing through the component either heats or cools its face in contact with the vesicle section 13. The heat is transferred to the vesicle interior, being assisted in this by the provision of the sponge matrix 12, and causes some of the fluid to change its state from liquid to vapor, or vice versa, and accordingly, the vesicle pressure to rise to a greater or lesser extent as required.

It should be noted that the response time, i.e. the time lag from the pressure change within the helmet and its adjustment is in actual practice of a few seconds. In the event that a shock is applied to the crash helmet, thereby a pressure increase would occur in the vesicle, this pressure increase is not adjusted because of its almost instantaneous character with a duration of just few milliseconds, that is, far shorter than the response time for adjustment.

Therefore, a pressure increase due to a shock would be retained in the helmet long enough to provide the desired anti-shock effect.

On the occurrence of a pressure increase due to a shock, partial condensation of the vapor takes place within the vesicle, and this even in the absence of any transfer of heat to the outside, i.e. in accordance with an adiabatic compression.

That vapor condensation results in an energy absorption, and hence, an improved anti-shock effect of the helmet padding element.

Through the provision of the sponge matrix, which affords a large surface area of contact between the liquid phase and the vapor phase, this desirable condensation is greatly enhanced.

Where, due to a malfunction, an uncontrolled excessive increase occurs in the vesicle temperature, the safety thermal switch, as suitably calibrated, will cut off the power supply.

When the user wants to take off the helmet, he/she depresses the key T to set a minimum pressure in the storage unit and, consequently, cause the vesicle pressure to promptly adjust itself to that minimum value. The current supplied to the Peltier component will change in sign to cause the face 17, and hence the fluid 11, to be cooled until the latter is fully condensed. Thus, a rapid reduction of the vesicle volume is brought about. As a result, the helmet can be quickly lifted off the head.

A major advantage of the padding element according to the invention is that the helmet is conferred unusual ability to fit over the user's head and unusually comfortable wearing features. In fact, it enables the helmet to fit close around the head to exert an optimum pressure thereon.

A further advantage is that such comfortable wearing features are retained unaltered even on the occurrence of changes in the environmental and climatic conditions under which the crash helmet is being used.

Another advantage of the padding element according to the invention is that it affords an improved degree of safety for the user in the event of a shock. In fact, it has shown an improved ability to absorb energy, thanks to the enhanced adiabatic condensation taking place within the vesicles on impacting.

The padding element of this invention makes for easy adaptability to wide range of different sizes, thereby it can be sold in a single size, with attendant advantages of a practical nature.

It also enables the crash helmet weight and overall dimensions to be reduced, which is obviously beneficial to its sporting applications.

Still another advantage of the crash helmet of this invention is that it can be lifted off the head without delay, both in normal use by the user, and in the event of an accident by the rescue team.

It is understood that the padding element for protection against shocks, according to the invention, while described in the foregoing with reference to its application to a crash helmet, may also be applied to other articles for use by human beings, e.g. a ski boot.

It also stands to reason that the padding element disclosed herein may be altered and modified in many ways by a skilled person in the art, to meet specific contingent demands, without departing from the true scope of the invention as set forth in the claims which follow.

What is claimed is:

1. A padding element for protection against shocks, particularly useful with a crash helmet, being of a type which comprises at least one deformable vesicle containing a fluid which, in use of the padding element, is in a saturated vapor state, characterized in that it comprises a temperature adjuster means connected to a power supply and associated with said at least one vesicle to vary the vesicle internal pressure by developing or absorbing heat.

2. A padding element for protection against shocks, particularly useful with a crash helmet, being of a type which comprises at least one deformable vesicle containing a fluid which, in use of the padding element, is in a saturated vapor state, characterized in that it comprises a temperature adjuster means connected to a power supply and associated with said vesicle for adjusting the temperature until the fluid has been fully condensed to vary the vesicle volume to assist in removal of the helmet.

3. A padding element according to claim 1, characterized in that said temperature adjuster means comprises a Peltier-effect thermoelectronic component having a first face and an opposite free face, said first face being in contact with a surface section of said at least one vesicle, and a power supply operative to supply an electric current in either directions to said component, to thereby develop or absorb heat at said face.

4. A padding element according to claim 3, characterized in that it includes a heat exchanger operative between the opposite free face of the component and environmental conditions.

5. A padding element according to claim 4, characterized in that said heat exchanger is a metal plate having a wall in contact with said free face of the component and an opposite wall formed with fins.

6. A padding element according to claim 5, characterized in that said padding element comprises a heat-insulative liner extending over said vesicle.

7. A padding element according to claim 6, characterized in that said liner comprises an envelope enclosing said vesicle and defining an interspace therewith.

8. A padding element according to claim 2, characterized in that said padding element comprises a means of sensing the pressure inside the vesicle, a storage unit fed with a pressure reference value, a comparator node fed with the sensed pressure and the reference pressure to issue a difference signal, and an electric current control means driven by said difference signal.

9. A padding element according to claim 8, characterized in that said vesicle pressure sensing means comprises a pressure transducer facing said interspace.

10. A padding element according to claim 1, characterized in that said fluid has a boiling temperature within the range of 10° C. to 70° C. at atmospheric pressure.

11. A padding element according to claim 10, characterized in that said fluid is a mixture.

12. A padding element according to claim 11, characterized in that said fluid is a mixture of several different Freon's.

13. A padding element according to claim 12, characterized in that said fluid is a mixture of Freon MF and Freon TF.

14. A padding element according to claim 13, characterized in that the percent amount of Freon MF in said mixture is in the 20% to 50% range by volume of liquid.

15. A padding element according to claim 14, characterized in that said mixture comprises 40% Freon MF and 60% Freon TF by volume of liquid.

16. A padding element according to claim 1, characterized in that said padding element comprises a sponge matrix placed inside said at least one vesicle.

17. A padding element according to claim 16, characterized in that said sponge matrix is formed from a heat-conductive material.

18. A padding element according to claim 17, characterized in that said heat-conductive material is polypyrrole.

* * * * *